US005143868A

United States Patent [19]

Caveney et al.

[11] Patent Number: 5,143,868

[45] Date of Patent: * Sep. 1, 1992

[54] COMMUNICATION BOX ASSEMBLY

[75] Inventors: Jack E. Caveney, Hinsdale; John J. Bulanda, New Lenox; Richard L. Fischer, Lisle; Andrew J. Stroede; Donald C. Wiencek, both of Tinley Park, all of Ill.

[73] Assignee: Panduit Corp., Tinley Park, Ill.

[ * ] Notice: The portion of the term of this patent subsequent to Oct. 24, 2006 has been disclaimed.

[21] Appl. No.: 694,518

[22] Filed: May 1, 1991

Related U.S. Application Data

[60] Continuation of Ser. No. 543,934, Jun. 22, 1990, Pat. No. 5,013,260, which is a division of Ser. No. 421,418, Oct. 16, 1989, Pat. No. 4,950,184, which is a division of Ser. No. 179,157, Apr. 8, 1988, Pat. No. 4,875,888.

[51] Int. Cl.[5] ..... H01R 13/73

[52] U.S. Cl. ..... 439/535; 439/540; 439/638

[58] Field of Search ..... 174/55, 66; 439/527, 439/535-538, 540, 570, 571, 638

[56] References Cited

U.S. PATENT DOCUMENTS

| | | | |
|---|---|---|---|
| 3,072,340 | 1/1963 | Dean | 439/291 |
| 3,501,736 | 3/1970 | Norris | 439/353 |
| 3,576,520 | 4/1971 | Stauffer | 439/716 |
| 3,944,176 | 3/1976 | Danko | 439/571 |
| 3,954,320 | 5/1976 | Hardesty | 439/418 |
| 4,290,664 | 9/1981 | Davis et al. | 379/442 |
| 4,303,296 | 12/1981 | Spaulding | 367/415 |
| 4,392,701 | 7/1983 | Weidler | 439/638 |
| 4,477,141 | 10/1984 | Hardesty | 439/535 |
| 4,482,200 | 11/1984 | Willenborg | 439/460 |
| 4,494,815 | 1/1985 | Brzostek et al. | 439/536 |
| 4,611,887 | 9/1986 | Glover et al. | 350/96.2 |
| 4,684,198 | 8/1987 | Becraft et al. | 439/571 |

FOREIGN PATENT DOCUMENTS 2855685 7/1979 Fed. Rep. of Germany .

*Primary Examiner*—Gary F. Paumen

*Attorney, Agent, or Firm*—Charles R. Wentzel; Mark D. Hilliard

[57] ABSTRACT

A communication box assembly includes a base, a plurality of connector mounting inserts, insert mounting means for securing the inserts to an inner surface of the base juxtaposed in an aligned row in a plurality of insert mounting positions, the insert mounting means positioning the inserts with outer insert edges adjacent an outer edge of the base whereby operative ends of connectors carried by the inserts are positioned for convenient connection with office service cables, and a cover releasably attached to the base which is shaped to enclose the base and inserts.

20 Claims, 9 Drawing Sheets

COMMUNICATION BOX ASSEMBLY

This is a continuation of application Ser. No. 543,934 filed Jun. 22, 1990, U.S. Pat. No. 5,013,260, which is a division of application Ser. No. 421,418, filed Oct. 16, 1989, U.S. Pat. No. 4,950,184, which is a division of application Ser. No. 179,157, filed Apr. 8, 1988, U.S. Pat. No. 4,875,881.

FIELD OF THE INVENTION

The present invention relates generally to assemblies for securing communication connectors to a mounting surface and enclosing the connectors and the service providing cables joined thereto behind a protective housing. In particular, the present invention discloses a communication box assembly that provides for the on-site selection and mounting of standard communication connectors utilized in today's office communication network such as modular telephone jacks, coaxial connectors and fiber-optic connectors within mounting inserts that are designed to be releasably latched to a wall mounted base or plate; the inserts being easily removable for later installation of additional communication connectors or rearrangement of the connectors as communication requirements change without the necessity of installing a new wall mounted base.

DESCRIPTION OF THE PRIOR ART

Many varieties of connector housing assemblies have been proposed as solutions to the many and varied problems of specialized connector assemblies. These proposed solutions address the requirements of each specialized connector assembly and fail to address the need for a communications box assembly that can mount and present for convenient use a variety of the standard types of communication connectors needed to provide a voice, data and video communication network to a modern office. These prior specialized assemblies are not adaptable to future connector designs or connector arrangements without the redesign and installation of a substantial portion of the assembly, thus limiting the expected life span of these specialized assemblies in light of the rapidly changing communication needs in today's office environment.

DISCLOSURE OF THE INVENTION

It is an object of the present invention to provide a communication box assembly that securely mounts and encloses standard office communication connectors, such as modular telephone jacks, coaxial connectors and fiber optic connectors in a convenient position and within an aesthetically pleasing enclosure on an office wall such that the specific choice of connectors and arrangement of connectors within the box can be made on site and can be easily modified.

It is a further object of the present invention to provide a communication box assembly that provides increased mounting stability for connectors secured therein.

It is an additional object of the present invention to provide a communication box assembly that maximizes the number of connectors that can be mounted within one assembly.

It is a further object of the present invention to provide a communication box assembly that maximizes the number of components that can be molded in simple two plate molds without side action to minimize the costs of manufacture.

It is another object of the present invention to provide a communication box assembly that is simple to install without the need for special tools.

In general, the communication box assembly of the present invention includes a base, a plurality of connector mounting inserts with each insert having an elongate body member and a connector mounting means for securing a connector to and above the body member, and insert mounting means for securing the inserts to an inner surface of the base juxtaposed side by side in an aligned row in a plurality of insert mounting positions, the insert mounting means positioning the inserts with outer insert edges adjacent an outer edge of the base whereby operative ends of connectors carried by the inserts are positioned for convenient connection with the service cables or wire of the office communication network.

DESCRIPTION OF THE PREFERRED EMBODIMENTS

A modern office communication network can include a variety of voice, data and video cables which connect; for example, central office telephone equipment to individual telephones and main frame computers to remote personal computers. The terminal ends of these cable are provided with appropriate connectors for selective interconnection to remote equipment. The present invention provides a means to securely mount a variety of these connectors in one enclosure for subsequent connection to the office equipment.

Figure 1:
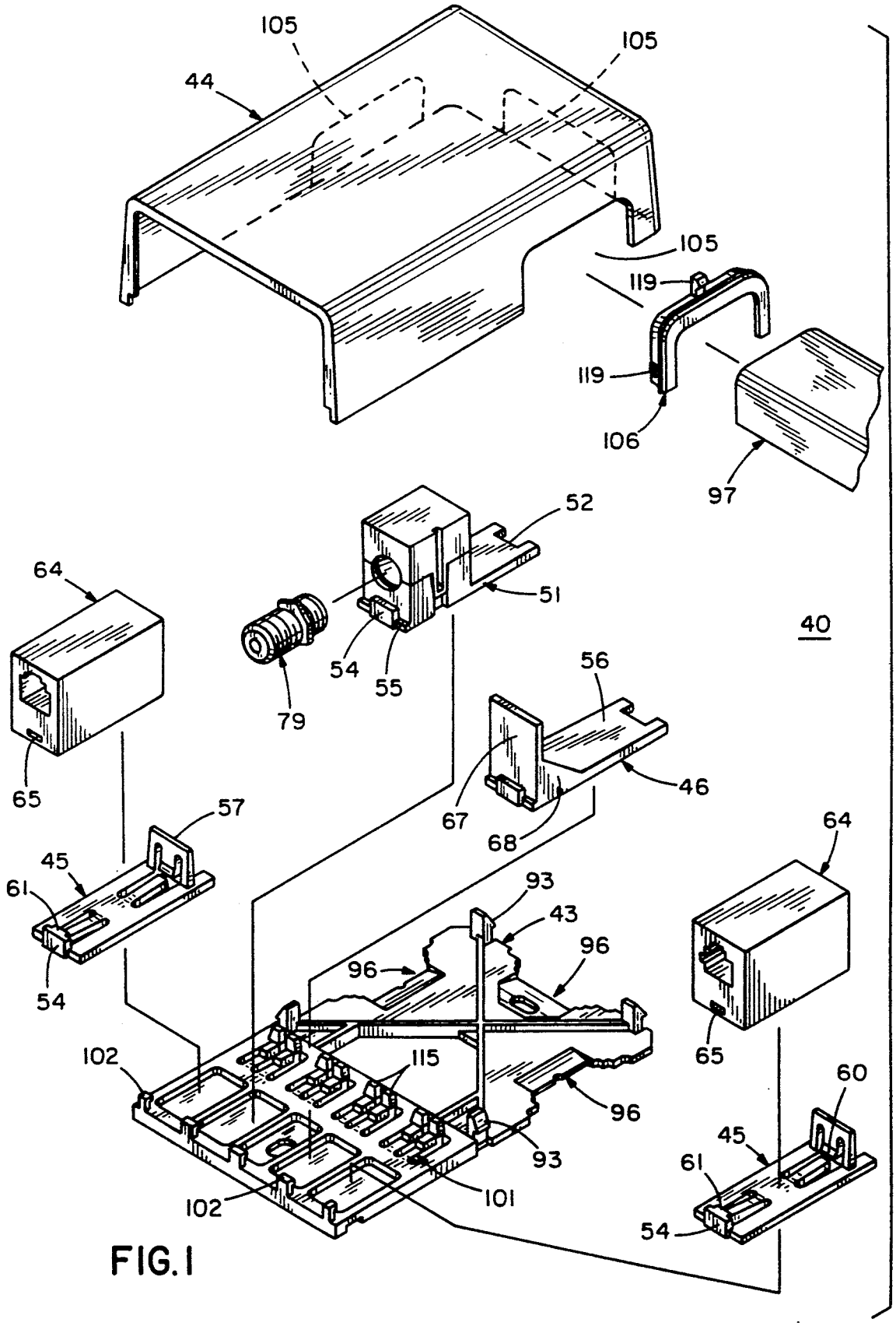
FIG. 1 is an exploded perspective view in isometric projection of one configuration of a communication box assembly embodying the concept of the present invention.
Figure 2:
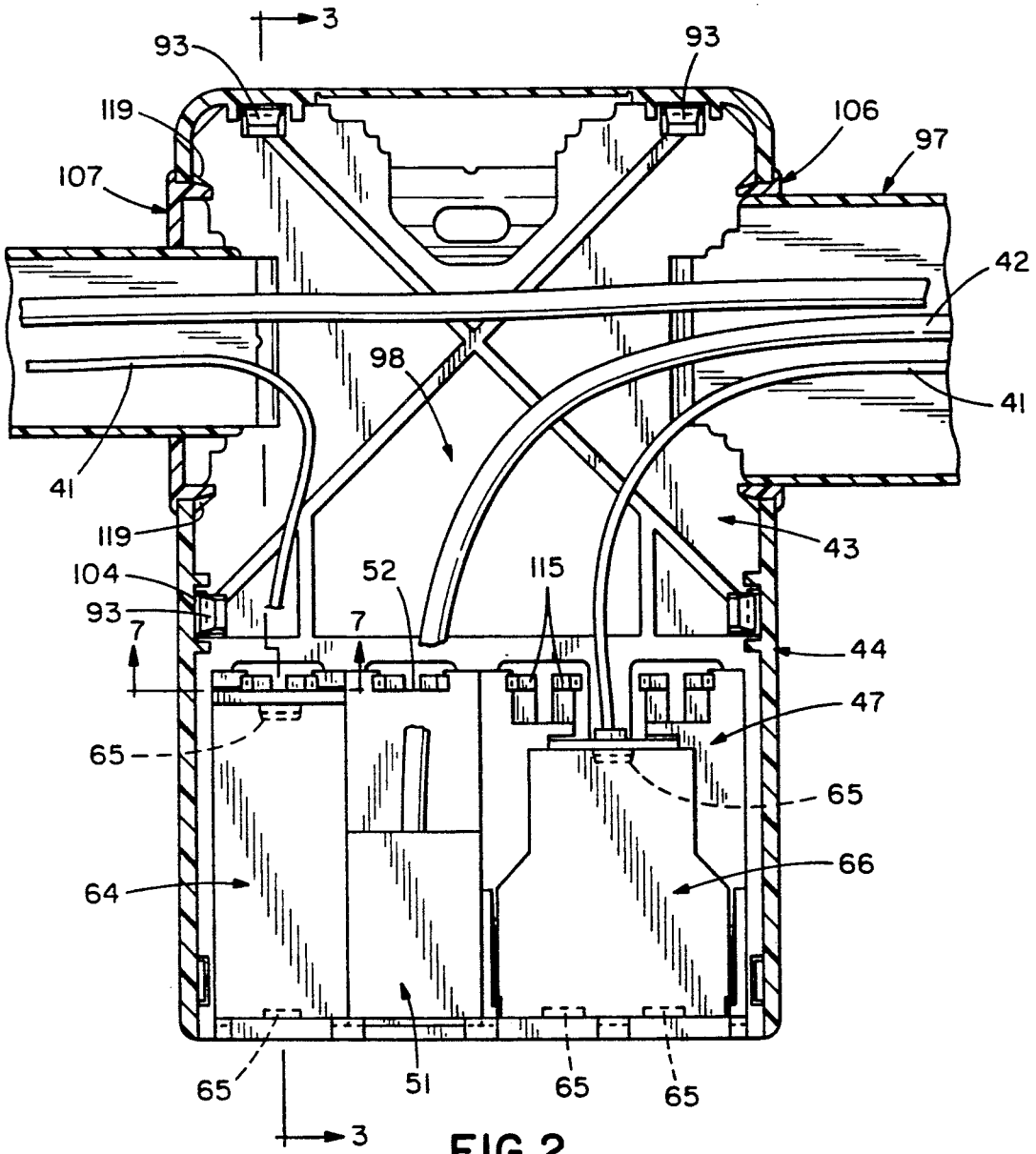
FIG. 2 is a top view of a different configuration of the assembly of the present invention with the cover cut away to show the assembly installed on an office wall.

The preferred design of a communication box assembly embodying the concept of the present invention is designated generally by the number 40 in the accompanying drawings. As depicted in FIG. 1, assembly 40 comprises a plurality of interlocking parts that can be selected and assembled on site without tools to mount a variety of office communication connectors to a mounting surface for connection with office equipment through; for example, a telephone wire 41 and a coaxial cable 42 as seen in FIG. 2. The communication box assembly 40 includes a base 43, a cover 44, and a plurality of inserts for mounting varied communication connectors, representative inserts disclosed in the drawings being designated in the following manner: telephone jack insert 45 (see FIGS. 8 and 9), blank insert 46 (see FIG. 1), splitter jack insert 47 (see FIGS. 2, 10, 11 and 12), reverse splitter jack insert 48 (see FIG. 13), direct wire insert 50 (see FIGS. 14 and 15) and coaxial connector insert 51 (see FIGS. 16 and 17). All of the components of assembly 40 are injection molded of suitable thermoplastic materials in a manner known in the art; all of the components except adapters 106 and 107 and wall plate 121 being designed to allow the use of two plate molds without the need for side action to minimize the cost of manufacture.

As seen in FIGS. 8–17, all of the inserts include at least one C-shaped latch slot 52 formed in an edge of each insert with each latch slot 52 having opposed edges 53. All of the inserts also include at least one positioning pad 54 and two shelves 55 formed at the outer edge of each insert on either side of pads 54 spaced back from the outer edges of each pad 54 or pair of pads 54. All of the inserts are formed with a common length and with a common width, or a multiple of the common width. Positioning pads 54 are medially disposed within each increment of common width of each insert, pads 59 being formed singly or in pairs for double width inserts.

Figure 8:
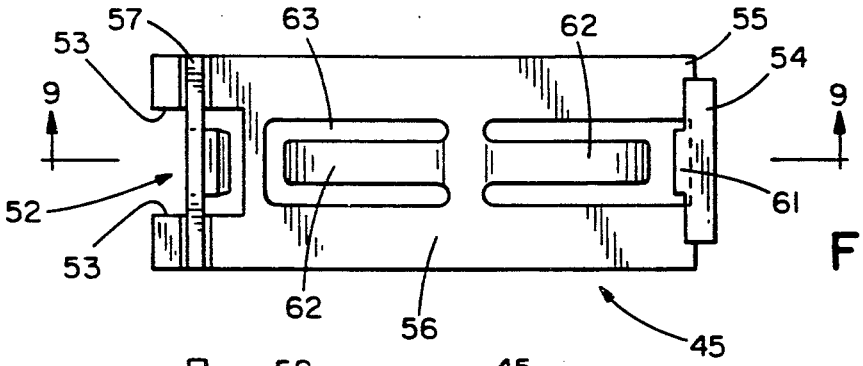
FIGS. 8 and 9 are respectively a top view and a sectional view taken along line 9—9 of FIG. 8 of the telephone jack insert shown in FIG. 1.
Figure 9:
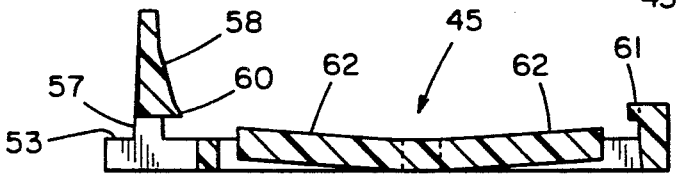

In particular, attention is directed to FIGS. 8 and 9 which depict the features of telephone jack insert 45. Telephone jack insert 45 includes a plate member 56 having opposed slot 52 and positioning pad 54 as discussed above. Formed adjacent latch slot 52 and projecting upwardly, perpendicular to the plane of plate member 56 is frame 57. A cantilever latch 58 is integrally formed within the surface of frame 57, the latch 58 presenting a tooth 60 which projects inwardly beyond the inner surface of frame 57. Formed adjacent the opposite edge of telephone jack insert 45 and projecting back toward latch 58 is a modular connector engaging lug 61. Integrally formed in insert 45, between frame 57 and lug 61 are two resilient springs 62, each being defined by a U-shaped slot 63 and each being molded to project upwardly at a free end above the plane of the surface of plate member 56.

Figure 3:
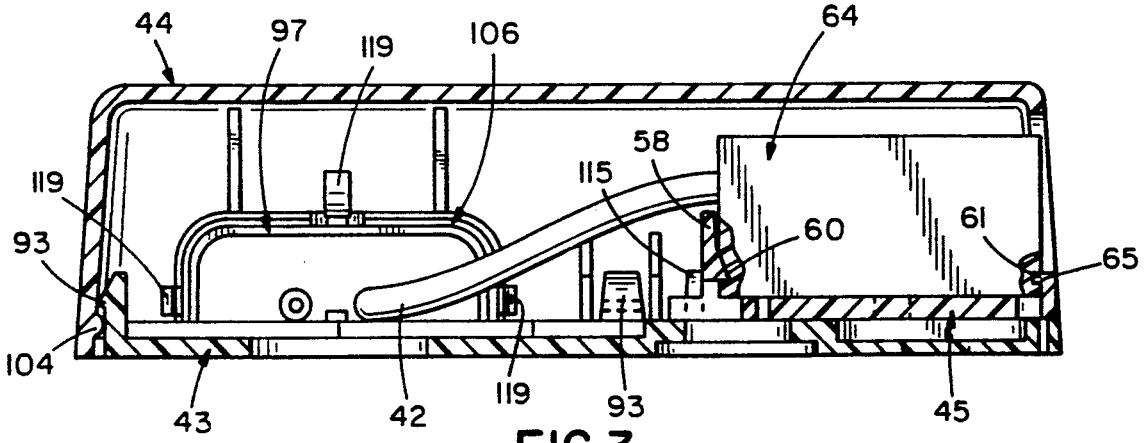
FIG. 3 is a sectional view of the assembly taken along line 3—3 of FIG. 2.
Figure 4:
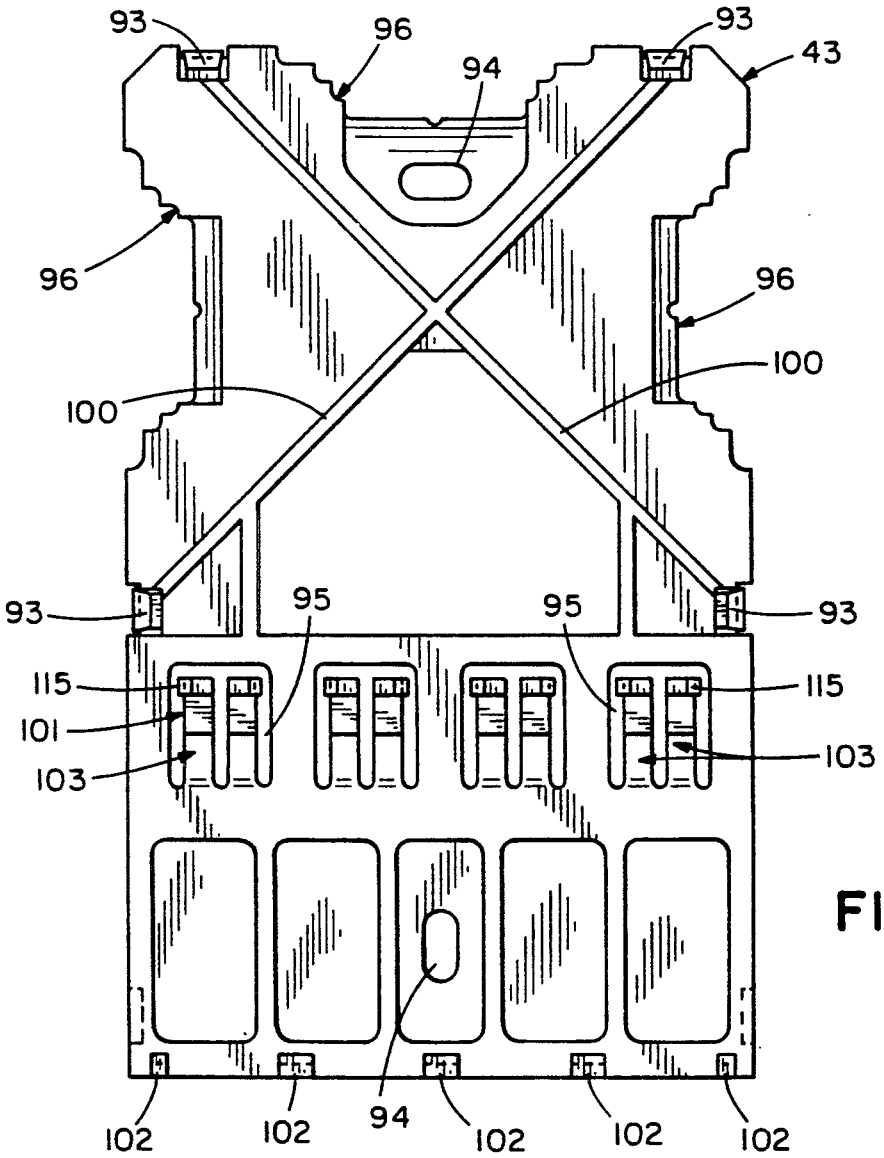
FIG. 4 is a top view of the base of the assembly of FIG. 1.

Telephone jack insert 45 mounts a standard in-line coupler 64. As best seen in FIGS. 1 and 3, a standard modular in-line coupler 64 includes a plastic body that presents end to end standard telephone jacks that accept standard modular telephone plugs (not shown) of the type described in U.S. Pat. No. 3,954,320, which is incorporated here in by reference; the coupler 64 including opposed slots 65 disposed at opposite ends. The distal end of lug 61 and tooth 60 of latch 58 are disposed to each engage respective slots 65 when coupler 64 is inserted into insert 45; a slot 65 of coupler 64 first being brought into engagement with the end of lug 61 and coupler 64 then being rotated into locking engagement between resiliently mounted tooth 60 and the other slot 65 of coupler 64. Springs 62 are disposed to resiliently engage coupler 64 before locking engagement between tooth 60 and coupler 64 to firmly secure coupler 64 to insert 45.

If desired, coupler 64 and insert 45 may be integrally formed with the structural features of the insert needed to latch the connector within the assembly being formed on the connector body.

Figure 10:
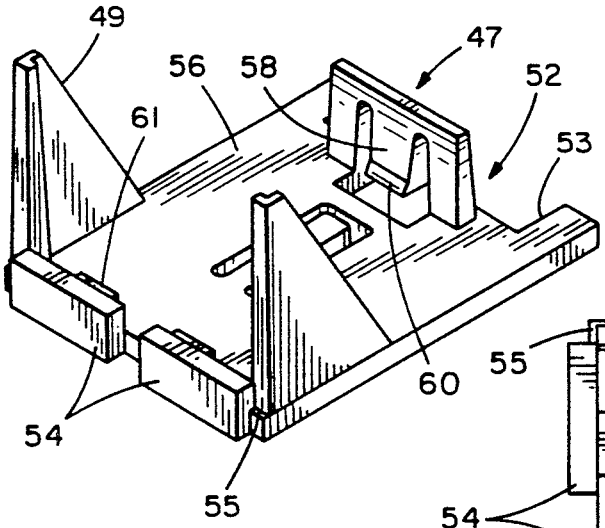
FIGS. 10, 11 and 12 are respectively a perspective view in isometric projection, a top view and a rear view of a splitter jack insert.
Figure 11:
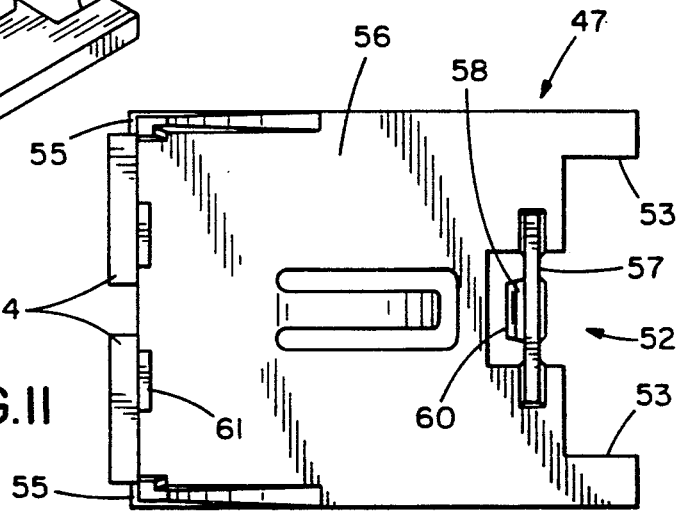
Figure 12:
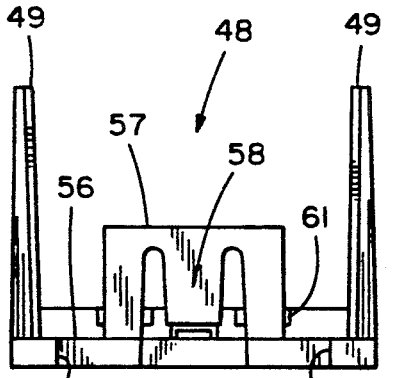
Figure 13:
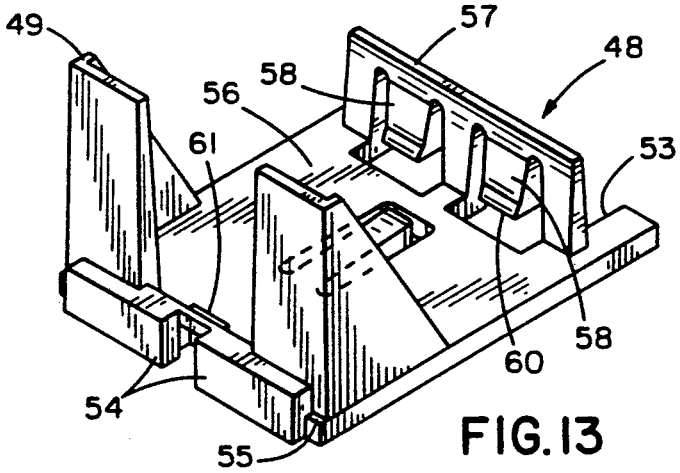
FIG. 13 is a perspective view in isometric projection of a reverse splitter jack insert.

Splitter jack insert 47 and reverse splitter jack insert 48, as seen in FIGS. 10–12; and FIG. 13, share features identical to those described above for telephone jack insert 45 but are twice the width of inserts 48 and include positioning wings 49, double width latch slots 52, two positioning pads 54, and either a combination of two lugs 61 and a single cantilever latch 58 for insert 47 or a combination of a single lug 61 and two cantilever latches 58 for insert 48. Both inserts 47 and 48 mount a standard splitter modular jack in-line coupler 66 as shown installed in insert 47 in FIG. 2, the coupler 66 having two side by side slots 65 positioned on a double jack side of the connector and a third slot 65 formed adjacent the single jack positioned on the opposite side of the coupler 66.

Blank insert 46 (as seen in FIG. 1) includes a plate member 56, an upwardly disposed planar wall 67 and a pair of reinforcing gussets 68. Blank insert 46 is used to enclose openings left in a completed assembly 40 in which all available insert mounting positions are not filled with connector inserts.

Figure 14:
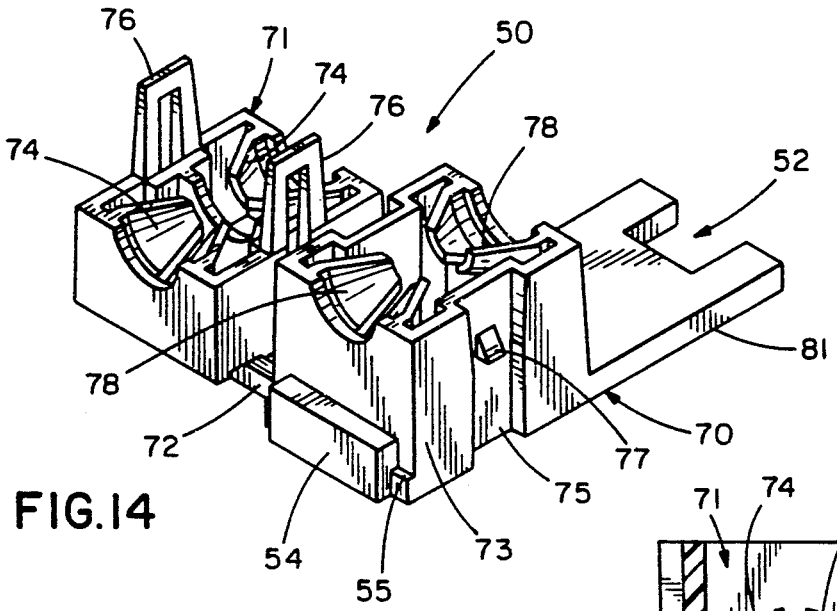
FIG. 14 is a perspective view in isometric projection of a direct wire insert.
Figure 15:
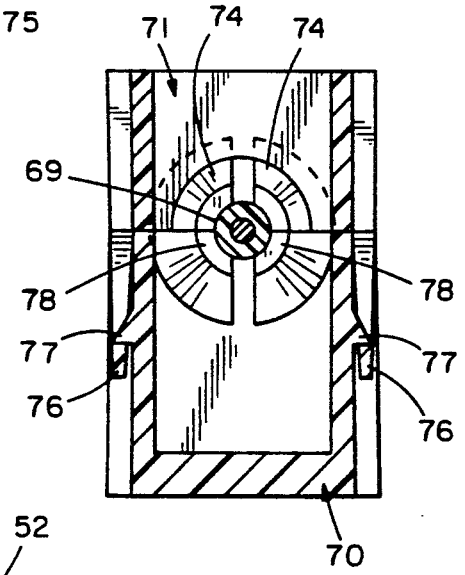
FIG. 15 is a sectional view of the insert of FIG. 14 showing a wire secured between the latched halves of the insert.

Direct wire insert 50, as best seen in FIGS. 14 and 15, is designed to secure a wire 69 between its base 70 and lid 71 to provide two directional axial strain relief for wire 69 secured therein such that a wire can extend outwardly of assembly 40 to present a connector secured to the terminal end of wire 69 with the wire 69 being fixed relative to assembly 40. Base 70 and lid 71 are integrally molded, joined by a frangible connecting arm 72 which is easily broken from the base and lid to yield two interlocking pieces as seen in FIG. 15. Base 70 includes a rectangular raised body portion 73 having two pair of internally formed, inner directed, resilient, conic shaped fingers 78 attached to opposing outer edges of base 70 for resiliently engaging a wire 69 when secured between lid 71 and base 70. Channels 75 for accepting cantilever latches 76 are formed in opposed sides of direct wire insert 50, having lugs 77 formed thereon. Cantilever latches 76 resiliently expand over and latch against lugs 77 to secure lid 71 to base 70. Lid 71 includes two pair of internally formed, inner directed, resilient, conic shaped fingers 74 formed on opposite edges of lid 71 disposed directly opposite to corresponding fingers 78 in base 70 when the lid and base are latched together. A strengthening rib 80 is formed between each pair of fingers 78 with an arcuate depression preventing interference with a wire secured between fingers 74 and 78. Positioning pad 54 and latch slot 52 formed in a plate portion 81 are provided on opposite edges of insert 50.

Figure 16:
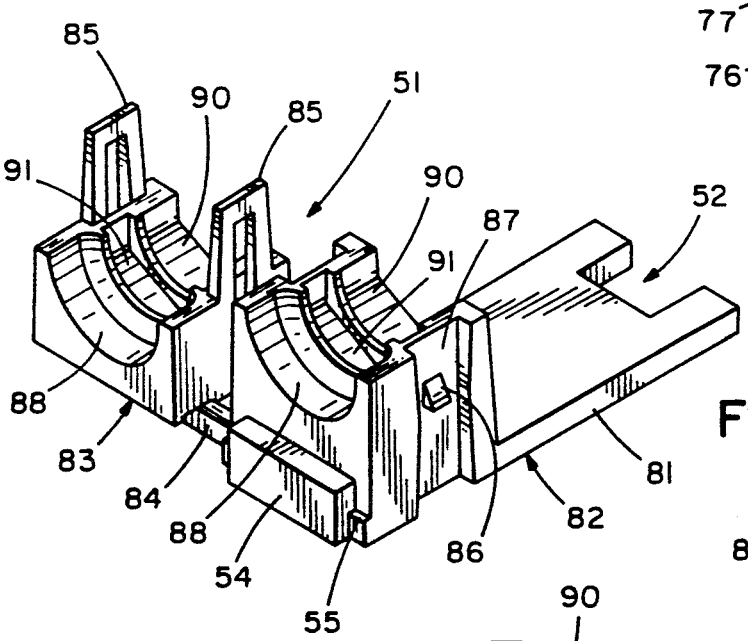
FIGS. 16 and 17 are respectively a perspective view in isometric projection and a rear view of a coaxial connector insert.
Figure 17:
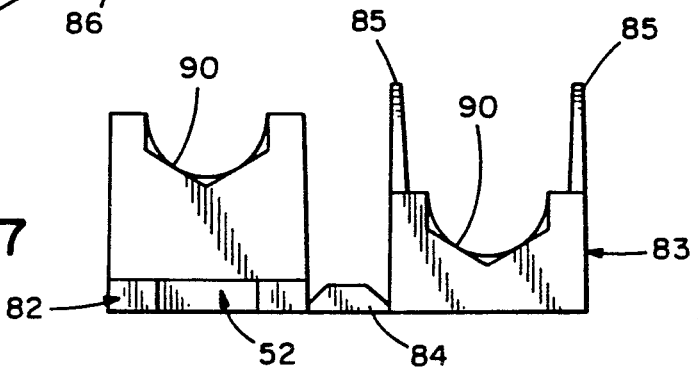

Coaxial connector insert 51, as seen in FIGS. 16 and 17, is designed to secure either a standard twist-on-jack coaxial connector (not shown) or a standard female-to-female coaxial connector 79 between an interlocking base 82 and lid 83. Base 82 and lid 83 are integrally molded in a manner similar to direct wire insert 50 with a frangible connecting arm 84 being easily broken from the base and lid to yield two interlocking pieces. Lid 83 includes outwardly projecting latching cantilever latches 85 disposed to engage lugs 86 formed in channels 87 in opposing sides of base 82. Forward pocket 88 and rear hexagonal pockets 90 in base 82 and lid 83 accept and secure corresponding portions of a coaxial twist-on jack to secure it therebetween. Inner pocket 91 is shaped to enclose and secure a medially disposed hexagonal nut collar of a female-to-female coaxial connector 79 shown in FIG. 1.

Base 43, as best seen in FIGS. 4–7, is a generally planar mounting plate including a plurality of resilient cover latches 93 spaced around the periphery of base 43 to secure the cover 44 to the base, mounting holes 94 for receiving mounting screws (not shown) for attaching the base to a mounting surface, a plurality of raceway recesses 96 disposed in the top and side edges of base 43 and shaped to engage with standard surface raceways 97 provided to assembly 40, a cable access window 98 for receipt of cables provide through the mounting surface, reinforcing ridges 100 formed in base 43, and insert mounting means including parallel rows of releasable insert latches 101 and directly opposed insert trapping lugs 102.

Figure 5:
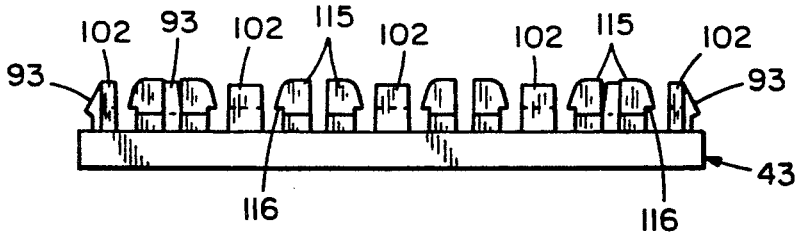
FIG. 5 is a front view of the base of FIG. 4.
Figure 6:
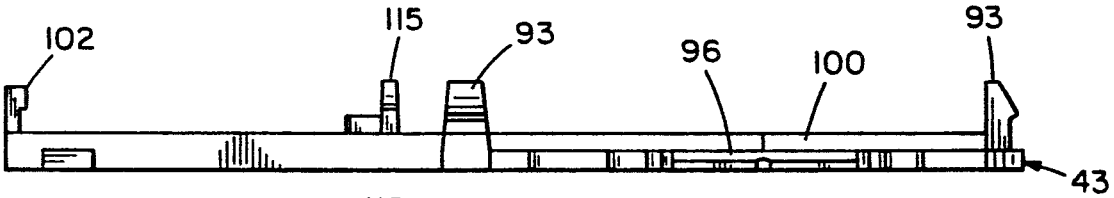
FIG. 6 is a side view of the base of FIG. 4.

Each releasable insert latch 101 includes a pair of parallel elongate spaced apart arms 103 formed in the planar surface of base 43 by an M-shaped slot 95. Arms 103 project outwardly from a point of attachment to base 43 to free ends that present upwardly directed barbs 115. Barbs 115, as best seen in FIG. 5 together form an arrow shaped profile, that is perpendicular to the plane of base 43, barbs 115 each having an outwardly directed insert engaging edges 116.

Figure 7:
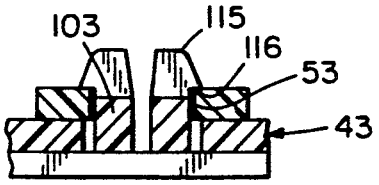
FIG. 7 is a sectional view taken along line 7—7 of FIG. 2.

As seen in FIG. 7, arms 103 are formed to space barbs 115 and opposed edges 116 apart an amount sufficient to allow arms 103 to resiliently deform inwardly as barb engaging edges 53 of latch slot 52 are inserted past barbs 115 and resiliently expanded outwardly to engage barbs 115 with edges 53 of each insert to resliently secure each mounted insert and prevent rattling of the mounted insert. The maximum deflection of arms 103 when the arms 103 are brought into abutment is limited to the space separating the arms 103 which is selected so that the maximum inward deflection is limited to resilient deflection, thus preventing excessive deflection of arms 103 and reducing failure of arms 103. Each releasable latch 101 projects above an insert secured thereby an amount sufficient to allow the distal ends of the barbs to be compressed inwardly to allow release and easy removal of an insert from the latch 101. Two spaced apart adjacent lugs 102 are positioned opposite to and aligned with each respective latch 101 in a manner to allow positioning pad 54 of an insert to be first inserted between adjacent lugs 102 with lugs 102 projecting over shelves 55 of the insert to trap the insert underneath lugs 102, and then rotated into releasable locking engagement between latch 101 and latch slot edges 53 of the insert; pads 76 of each insert filling the space between adjacent lugs 102 to center the insert relative to adjacent lugs 102 and aligned latch 101. The design of lugs 102, positioning pad 54 and shelves 55 allow the inserts and the connector carried thereon to be mounted as near as possible to the edge of base 43 while securely mounting and accurately centering each insert and connector mounted thereon to the base.

The features of base 43 are designed to allow the base to be integrally molded with a simple two plate mold without side action to minimize the cost of manufacturing base 43. Mold access openings (not shown) are formed in base 43 underneath the distal ends of insert trapping lugs 102 allowing lugs 102 to be formed with a simple two plate mold. Latches 101 formed by slots 95 in base 43 with barbs 115 projecting upwardly from and orthogonally to the surface of base 43 also allow the use of the two plate mold.

Once an insert is fastened within lugs 102 and a latch 101, the insert is securely fastened at opposite edges to base 43, thus providing increased stability for a connector mounted by the insert to base 43.

Insert trapping lugs 102 and releasable insert latches 101 are spaced apart such that the inserts can be mounted side-by-side without any unused space therebetween to maximize the number of connectors that can be mounted in the assembly 40. In addition the equal spacing of lugs 102 and latches 101 and the provision of inserts having common widths, or widths that are a multiple of the common width, allow the interchangeable use of a greater variety of connectors within the assembly.

Installation of assembly 40 is accomplished by securing base 43 to a mounting surface with appropriate fasteners, selecting and installing the desired combination of connectors and inserts and enclosing the base 43 and connectors secured thereto within cover 44. See FIG. 2 which illustrates the installation of a telephone jack insert 45 and coupler 64, a coaxial connector insert 51 and connector, and a splitter jack insert 47 and coupler 66. Cover 44, as seen in FIG. 2, includes ridges 104 positioned to engage cover latches 93 and releasably secure cover 44 to base 43. Cover 44 includes three molded knockout areas 105 that are designed to allow installation of standard plastic wire raceways 97. The knockout areas are dimensione to accept first or second adapters 106 and 107 which are secured to cover 44 by latches 119 and which allow the on-site selection assembly of varying sizes of raceways to assembly 40, as seen in FIG. 2.

Figure 18:
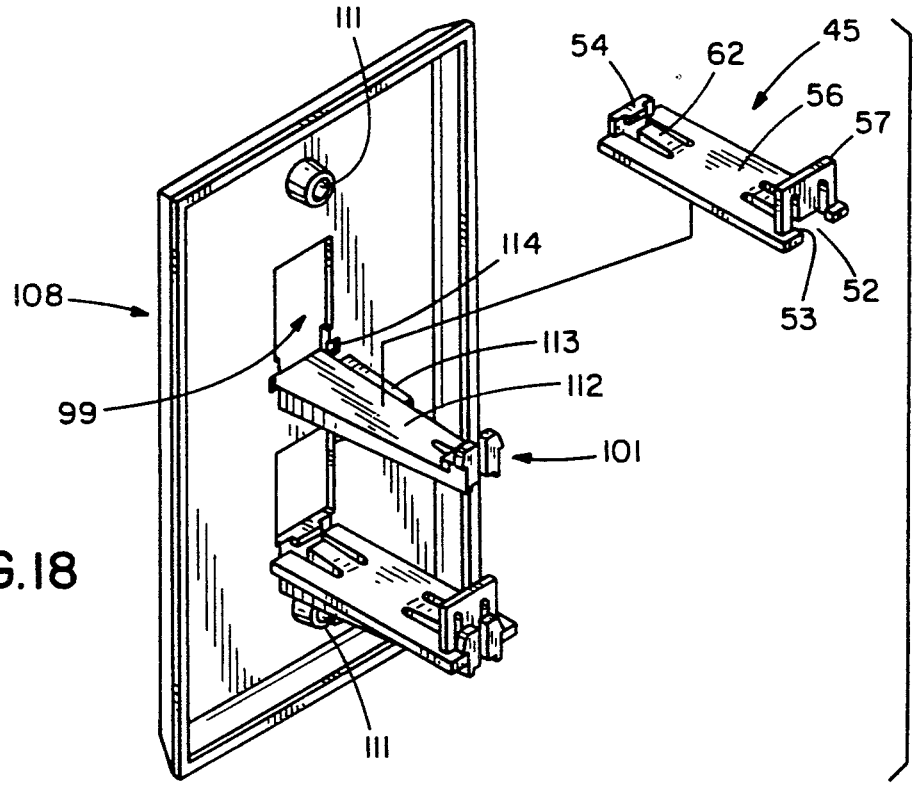
FIG. 18 is an exploded perspective view in isometric projection of a two connector wall plate and an insert mountable thereon.
Figure 19:
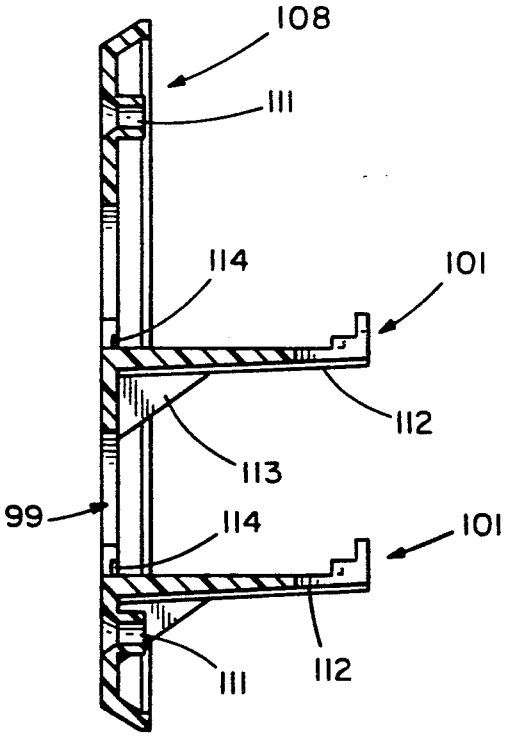
FIG. 19 is a side view in section taken along the longitudinal centerline of the wall plate of FIG. 18.
Figure 20:
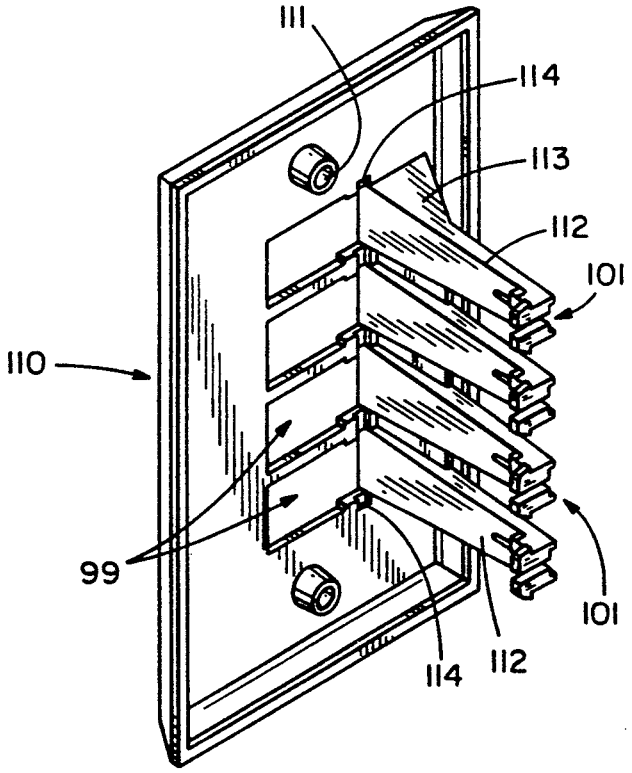
FIG. 20 is a perspective view in isometric projection of a four connector wall plate.

Above described assembly 40 is mounted on the surface of an office wall. In certain applications it is desirable to mount an assembly level with the surface of the wall within a standard switch and receptacle box. A wall plate assembly compatible with the components of assembly 40 is illustrated in FIGS. 18–19 and 20, which respectively illustrate a two connector wall plate 108 and a four connector wall plate 110. Both wall plates are designed to be preferably integrally molded in simple two plate molds without side action thus decreasing the cost of manufacture.

Both wall plates 108 and 110 are dimensioned and have mounting holes 111 positioned to secure each wall plate to a standard switch and receptacle box (not shown) to enclose connectors secured to the wall plates within the box. Both wall plates have insert mounting platforms 11 projecting orthogonally from wall plates 108 or 110 which are supported by reinforcing gussets 113, latches 101, connector access windows 99 and recessed slots 114. Slots 114 are formed to accept, position and secure the forward, positioning pad edge of any of the above described inserts; slot 114 extending outwardly of either side of platform 112 such that the centrally disposed positioning pad 54 of an insert mounted in slot 114 extends into window 99 and the edges of slot 114 trap shelves 55 of each insert to prevent forward or upward movement of the insert. Latches 101 are formed on each platform 112 with spaced apart arms formed in the distal end of each platform 112, the arms presenting upwardly projecting barbs disposed orthogonally to platform 112. Latches 101 operate as described above to releasably latch each insert within a mounting position in the wall plate.

In order to insure complete insert mounting compatibility between base 43 and wall plates 108 and 110, it is desirable that the insert mounting means of both base 43 and wall plates 108 and 110 be as structurally similar as possible while still allowing the manufacture of both the base and the wall plates 108 and 110 to be accomplished with a simple two plate mold without the need for side action. The design of the latches 101 as utilized in both the base and the wall plates 108 and 110 accomplish the desired close similarity, insert mounting compatibility and two plate mold manufacturing capability even though the orientation of each latch 101 in base 43 is rotated ninety degrees to the orientation of each latch formed on wall plates 108 and 110, relative to the planar mounting surfaces of the base 43 and the wall plates 108 and 110; latches 101 of base 43 projecting orthogonally from the planar surface of base 43 while latches 101 of wall plates 108 and 110 project orthogonally from platforms 112 and parallel to the planar surface of each wall plate 108 or 110.

Figure 21:
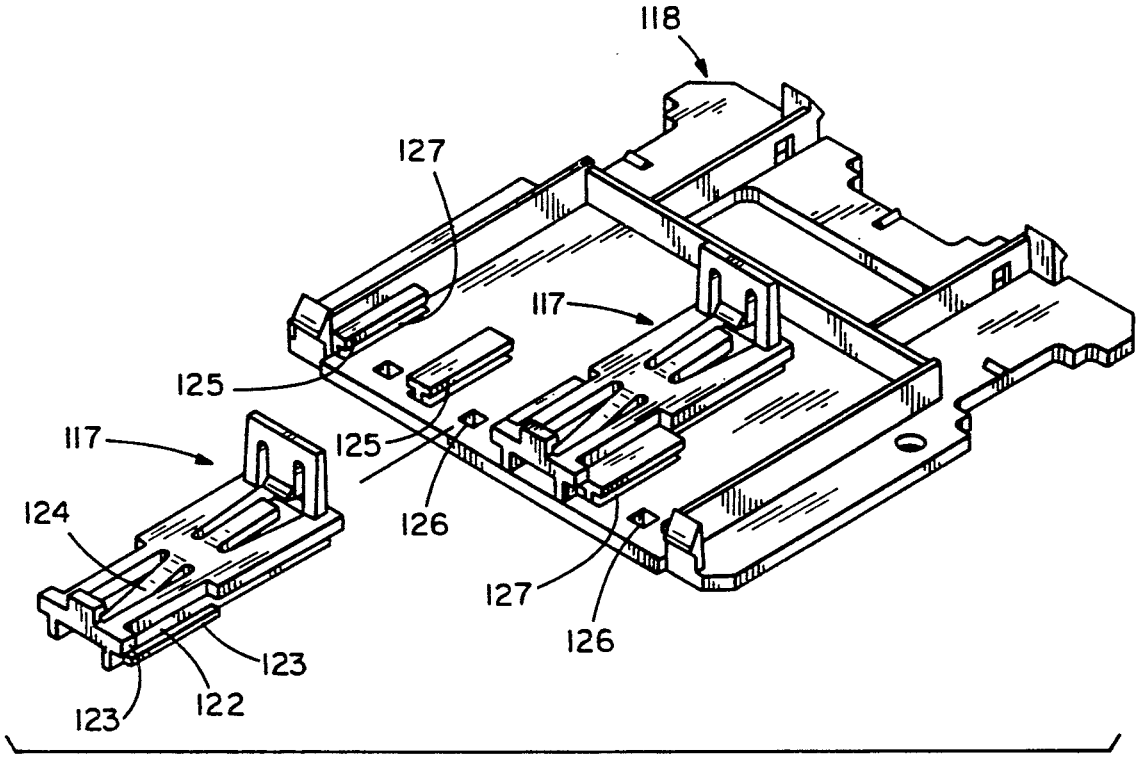
FIG. 21 is an exploded perspective view in isometric projection of a base and insert disclosing an alternate mounting means of the present invention.
Figure 22:
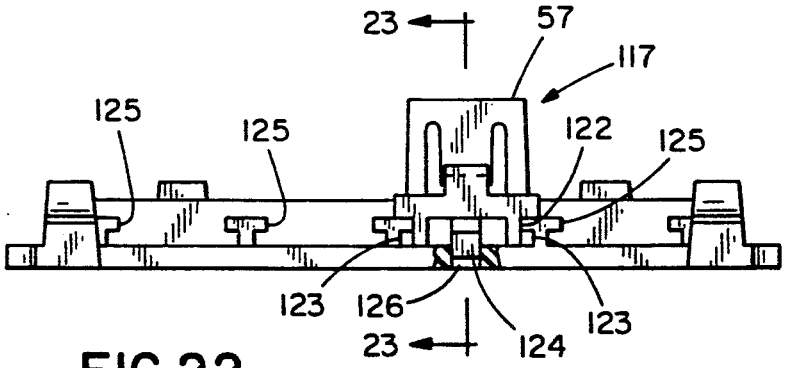
FIG. 22 is a front view of the base of FIG. 21.
Figure 23:
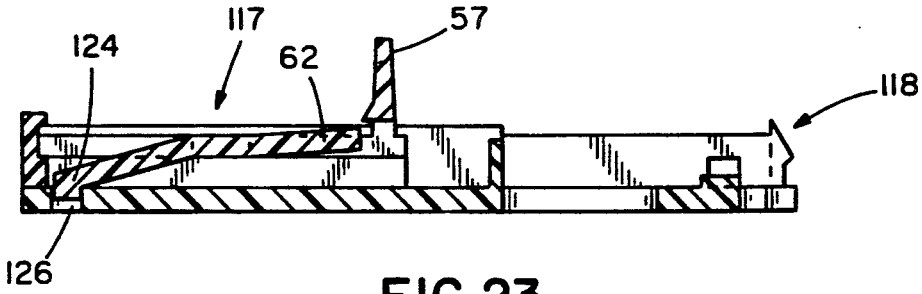
FIG. 23 is a sectional view taken along line 23—23 of FIG. 22.
Figure 24:
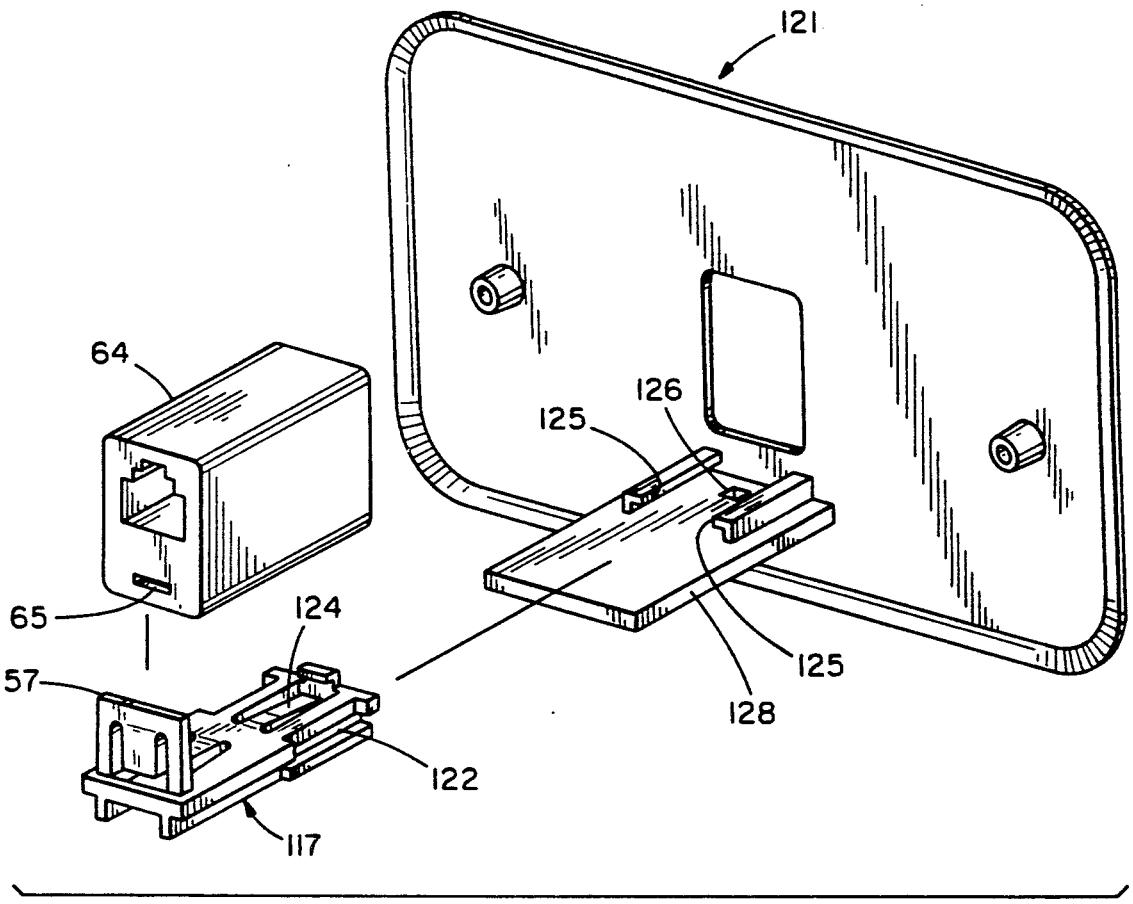
FIG. 24 is an exploded perspective of a wall plate assembly compatible with the mounting means of FIG. 21.
Figure 25:
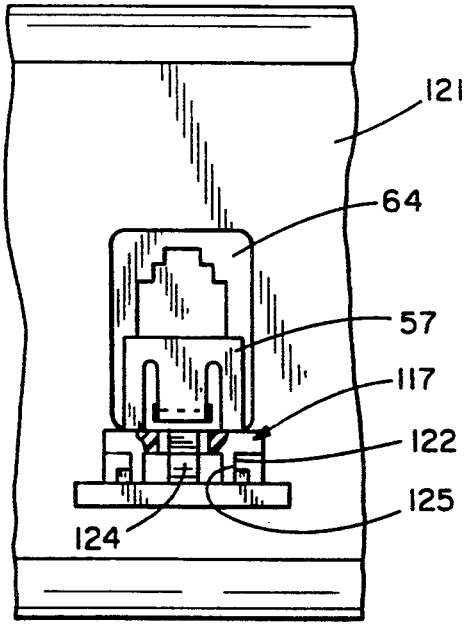
FIG. 25 is a front view of the wall plate of FIG. 24.
Figure 26:
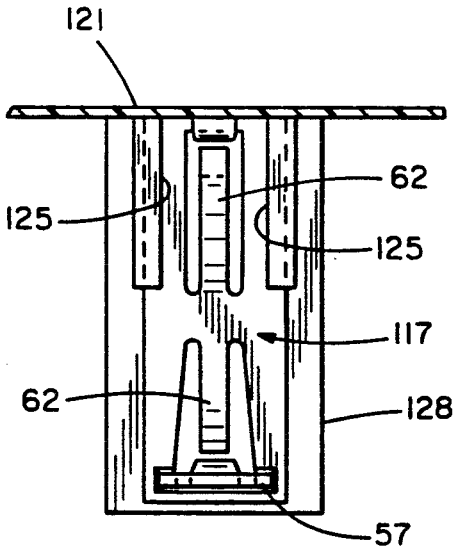
FIG. 26 is a top sectional view of the wall plate of FIG. 24 with a telephone jack insert secured to the wall plate.

An alternate means for mounting inserts to a base 118 is illustrated in FIGS. 21–23, or to a wall plate 121 compatible therewith is illustrated in FIGS. 24–26.

The alternate mounting means includes an insert 117 having lateral slots 122 defined by spaced apart lateral flanges 123 extending along opposing edges of insert 117 and a resilient downwardly projecting latching arm 124. Base 118 defines a number of mounting positions for each insert 117 with opposed inwardly directed parallel insert positioning ribs 125 disposed to be received within lateral slots 122 to align and secure each insert 117 laterally and a window 126 formed between each rib 125 and disposed to receive the end of latching arm 124 to secure the insert 117 against longitudinal movement. The design of insert 117 and the design of base 118 which includes openings 127, allow insert 117 and base 118 to be molded with a two plate mold without side action, minimizing the costs of manufacture of the assembly.

Wall plate 121, as seen in FIGS. 24–26, includes a platform 128 extending orthogonally from the plane of wall plate 121. Spaced apart ribs 125 extend from the surface of the platform 128 and are spaced apart to enter lateral slots 122 of insert 117 and position it laterally. Window 126 is formed in platform 128 to receive latching arm 124 of insert 117 to secure insert 117 against longitudinal movement relative to platform 128.

Figure 27:
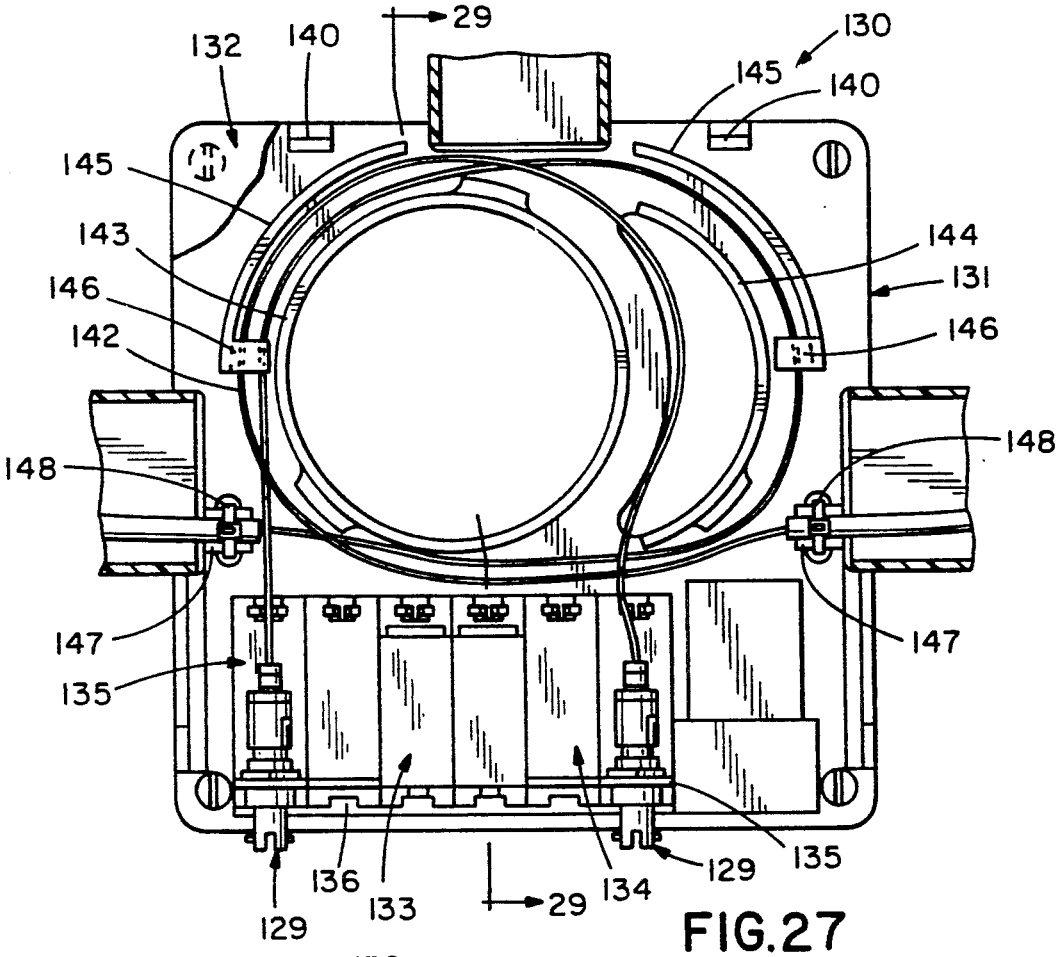
FIGS. 27, 28 and 29 are respectively a front view, an end view and a sectional view taken along line 29—29 of FIG. 27 of a second embodiment of the present invention comprising a fiber optic cable assembly box.
Figure 28:
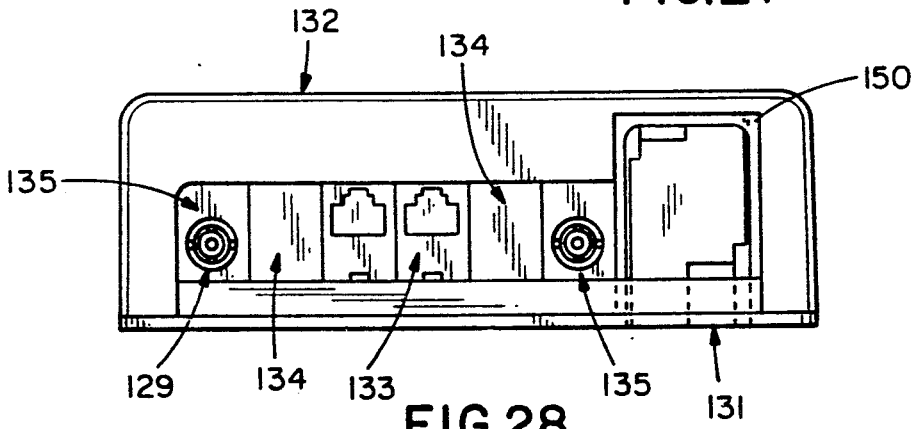
Figure 29:
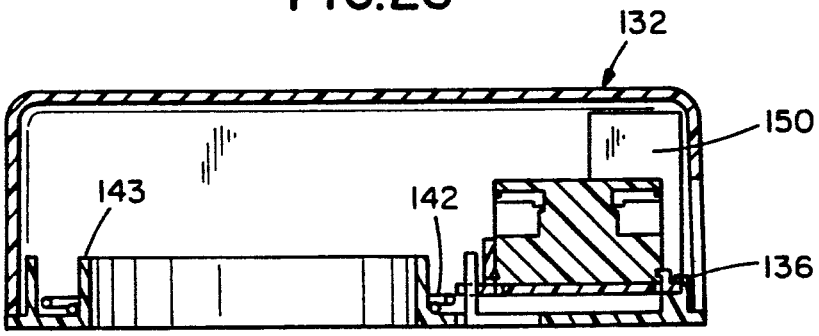

A fiber optic communication box assembly which is a second embodiment of the concept of the present invention is designated generally by the number 130 in FIGS. 27–29. Fiber optic communication box assembly 130 includes a base 131, a cover 132, telephone jack inserts 133, blank inserts 134, fiber optic cable connector inserts 135 mounting a fiber optic cable connector 129, cover latches 140, and raceway recesses. The inserts depicted in assembly 130 are secured to base 131 by the interengagement of L-shaped centering hooks 136 disposed along the outer edge of base 131 and an C-shaped slots formed in each insert. If desired, assembly 130 could be modified to include all of the insert and base details of above described assembly 40 to allow use of the inserts of assembly 40 in assembly 130.

Fiber optic communication box assembly 130 also includes integrally formed means for storing excess fiber optic cable 142 within the assembly's enclosure which includes a circular ridge 143, an adjacent inner arc 144 and two outer arcs 145 respectively disposed adjacent to and outwardly of circular ridge 143 and inner arc 144. Circular ridge 143 and inner and outer arcs 144 and 145 are disposed such that excess fiber optic cable entering the assembly at the duct recesses can be wound around and stored on circular ridge 143 and inner arc 144 with outer arcs 145 retaining cable 142 in a coil. Also preventing uncoiling of fiber optic cable 142 are wire trap flanges 146 formed along a part of the upper edge of outer arcs 145 and projecting inwardly toward adjacent portions of circular ridge 143 and inner arc 144.

Base 131 of assembly 130 also includes cable tie mounts 147 adjacent recesses that allow a cable tie 148 to secure the fiber optic cable 142 to base 131.

Fiber optic communication box assembly 130 also includes a specialized collar 150 integrally formed with base 131 and designed to accept and mount an International Business Machine's token ring connector (not shown). Although shown as integrally formed with base 131, collar 150 may also be formed with or attached to an insert as taught herein and base 131 may be formed with additional insert positions in place of the molded collar such that assembly 130 can be configured with or without a token ring connector collar.

While particular preferred embodiments of the invention have been shown and described, it is to be understood that numerous changes may be made in form and details without departing from the scope of the present invention. For example, although a variety of standard connector mounting inserts have been described, different inserts may be designed to accommodate different connector designs.

We claim:

1. A communication assembly for interchangeably mounting communication connectors for use in an office environment, comprising:

an integrally molded plastic assembly mounting means having means for attaching the assembly mounting means to a mounting surface;

a plurality of connector mounting inserts, the inserts having an elongate body member including connector mounting means for securing a connector to the body member, the inserts having a common length and having a multiple of a common width whereby the inserts are interchangeable within the assembly; and insert mounting means integrally formed in the assembly mounting means for independently mounting and positively locking each insert to the assembly mounting means against movement in any direction such that each insert can be individually mounted or individually removed without disturbance of any part of the insert mounting means which mounts an adjacently mounted insert; wherein the insert mounting means positions adjacent connector mounting inserts in juxtaposition along adjacent lateral edges thereof such that the space needed to mount a plurality of inserts to the assembly mounting means is minimized.

2. A communication assembly as set forth in claim 1, wherein the insert mounting means includes a plurality of equally spaced, aligned, independently releasable and positively locking insert latches disposed to each engage a respective connector mounting insert and independently mount each insert to the assembly mounting means.

3. A communication assembly as set forth in claim 2, wherein the insert latches are disposed opposite to and in direct correspondence with a plurality of equally spaced, aligned insert trapping lugs with each connector mounting insert including a positioning means formed in an edge of the insert for engaging corresponding adjacent said lugs to center the insert with respect to the lugs and a latch slot in an edge opposite the positioning means, the latch slot shaped to engage a corresponding said latch and center the insert with respect to the latch.

4. A communication assembly as set forth in claim 3, wherein each releasable latch includes a pair of resilient arms formed on the assembly mounting means having upwardly projecting latching barbs formed at their free ends, the arms being disposed apart an amount sufficient to allow the barbs to be resiliently deflected inwardly towards each other to releasably accept and latch an insert to the assembly mounting means and the arms being disposed sufficiently close together that the maximum inward deflection of the arms into abutment is limited to resilient deflection whereby excessive failure inducing deflection is prevented.

5. A communication assembly as set forth in claim 4, wherein the upwardly projecting barbs are disposed to be deflectable in a direction substantially orthogonal to the longitudinal axis of the insert secured thereby, whereby inadvertent diengagement of the insert from the communication box assembly during mating engagement of a second connector with the connector mounted on the insert is prevented.

6. A communication assembly as set forth in claim 3, including a standard modular in-line coupler having back to back telephone jacks that accept standard modular telephone plugs and wherein the connector mounting means of at least one of the inserts includes coupler mounting means for securing the coupler to the inset such that when the insert is secured within the assembly one jack of the coupler is presented outwardly for connection to a modular telephone connector of a office telephone wire network and the other jack is presented inwardly for connection within the assembly to a standard modular telephone plug of a central telephone system service wire.

7. A communication assembly as set forth in claim 2, wherein the insert latches are formed in a planar surface of the assembly mounting means such that an operative end of a connector mounted in the insert and secured in the latch is disposed along an edge of the assembly mounting means.

8. A communication assembly as set forth in claim 2, wherein the assembly mounting means includes a connector access window and wherein each of the latches is disposed at a distal end of a platform which projects orthogonally from a planar surface of the assembly mounting means such that an operative end of a connector mounted in the insert and secured to the assembly mounting means is disposed coincident with the window.

9. A communication assembly as set forth in claim 1, wherein the connector mounting inserts are formed integrally with a connector.

10. A communication assembly as set forth in claim 9, wherein the insert mounting means positions adjacent connector mounting inserts in contiguous juxtaposition along adjacent lateral edges such a that the space needed to mount a plurality of inserts to the assembly mounting means is minimized.

11. A communication assembly as set forth in claim 10, wherein the insert mounting means includes a plurality of equally spaced, aligned, independently releasable and positively locking insert latches disposed to each ingage a respective connector mounting insert and independently mount each insert to the assembly mounting means.

12. A communication assembly as set forth in claim 11, wherein the insert latches are disposed opposite to and in direct correspondence with a plurality of equally spaced, aligned insert trapping lugs with each connector mounting insert including a positioning means formed in an edge of the insert for engaging corresponding adjacent said lugs to center the insert with respect to the lugs and a latch slot in an edge opposite the positioning means, the latch slot shaped to engage a corresponding said latch and center the insert with respect to the latch.

13. A communication assembly as set forth in claim 12, wherein each releasable latch includes a pair of resilient arms formed on the assembly mounting means having upwardly projecting latching barbs formed at their free ends, the arms being disposed apart an amount sufficient to allow the barbs to be resiliently deflected inwardly towards each other to releasably accept and latch an insert to the assembly mounting means and the arms being disposed sufficiently close together that the maximum inward deflection of the arms into abutment is limited to resilient deflection whereby excessive failure inducing deflection is prevented.

14. A communication assembly as set forth in claim 13, wherein the upwardly projecting barbs are disposed to be deflectable in a direction substantially orthogonal to the longitudinal axis of the insert secured thereby, whereby inadvertent disengagement of the insert from the communication box assembly during mating engagement of a second connector with the connector mounted on the insert is prevented.

15. A communication assembly as set forth in claim 12, including a standard modular in-line coupler having back to back telephone jacks that accept standard modular telephone plugs and wherein the connector mounting means of at least one of the inserts includes coupler mounting means for securing the coupler to the insert such that when the insert is secured within the assembly one jack of the coupler is presented outwardly for connection to a modular telephone connector of a office telephone wire network and the other jack is presented inwardly for connection within the assembly to a standard modular telephone plug of a central telephone system service wire.

16. A communication assembly as set forth in claim 11, wherein the insert latches are formed in a planar surface of the assembly mounting means such that an operative end of a connector mounted in the insert and secured in the latch is disposed along an edge of the assembly mounting means.

17. A communication assembly as set forth in claim 11, wherein the assembly mounting means includes a connector access window and wherein each of the latches is disposed at a distal end of a platform which projects orthogonally from a planar surface of the assembly mounting means such that an operative end of a connector mounted in the insert and secured to the assembly mounting means is disposed coincident with the window.

18. A communication assembly as set forth in claim 1, including a kit of parts for mounting a connector to an office wall either above or recessed within the office wall, wherein the kit of parts includes at least two different assembly mounting means including a base and a wall plate either of which can be utilized to secure the insert to the wall;

the base having a first insert mounting means for securing the insert to a substantially planar inner surface of the base, the first insert mounting means positioning the insert with the first edge of the insert adjacent an outer edge of the base whereby the operative mating face of the connector carried by the insert is positioned for convenient connection with office service cables; and the wall plate having a second insert mounting means for securing the connector mounting insert within a standard electrical mounting box with the plane of the operative mating face of the connector mounted thereon being disposed substantially parallel to the wall plate having a structural features substantially similar to the first mounting means of the base whereby the connector mounting inserts can be interchangeably mounted within either the base or the wall plate.

19. A communication assembly as set forth in claim 18, wherein the connector mounting inserts are formed integrally with a connector.

20. A communication assembly as set forth in claim 19, wherein the first insert mounting means of the base includes an insert trapping lug means formed in the inner surface of the base for securing the first edge of the insert to the base and a first releasable insert latch formed in the base, the first latch having resilient spaced apart arms disposed parallel to the base and latching barbs formed on the arms and disposed orthogonally to the arms; and wherein the second insert mounting means of the wall plate includes an insert trapping slot means formed in the wall plate for securing the first edge of the insert to the wall plate, an insert mounting platform projecting orthogonally from the wall plate, and a second releasable insert latch having resilient spaced apart arms formed in a distal end of the platform with insert latching barbs formed on the arms, the barbs projecting orthogonally from the arms.

* * * * *